US007685672B2

(12) United States Patent
Lai et al.

(10) Patent No.: US 7,685,672 B2
(45) Date of Patent: Mar. 30, 2010

(54) VACUUM ERASER FOR BLACKBOARDS

(76) Inventors: Hsi-Hur Lai, 12315 Ashford Meadows Dr., Sugar Land, TX (US) 77478; Hsi-Huang Lai, No. 189, Chung Ming South Road, Taichung (TW) 403

( * ) Notice: Subject to any disclaimer, the term of this patent is extended or adjusted under 35 U.S.C. 154(b) by 999 days.

(21) Appl. No.: 11/131,470

(22) Filed: May 18, 2005

(65) Prior Publication Data

US 2006/0260092 A1 Nov. 23, 2006

(51) Int. Cl.
*A47L 5/24* (2006.01)

(52) U.S. Cl. ..... 15/344; 15/3.53; 15/352

(58) Field of Classification Search ..... 15/3.53, 15/344, 352, 366, 383, 22.3, 51, 99
See application file for complete search history.

(56) References Cited

U.S. PATENT DOCUMENTS 3,986,224 A * 10/1976 Yang ..... 15/114
4,462,134 A * 7/1984 Wang ..... 15/98
4,642,831 A * 2/1987 Roth ..... 15/1.51
4,742,594 A * 5/1988 Chen ..... 15/98
4,941,225 A * 7/1990 Liao ..... 15/98
5,216,776 A * 6/1993 Dennison ..... 15/312.1
5,537,711 A * 7/1996 Tseng ..... 15/344
6,370,720 B1 * 4/2002 Jang ..... 15/98
6,772,472 B2 * 8/2004 Wang ..... 15/344
7,222,391 B2 * 5/2007 Fan ..... 15/344

* cited by examiner

*Primary Examiner*—Dung Van Nguyen

(57) ABSTRACT

This invention is a new structure of blackboard eraser with cordless vacuum functionality. The main components in the design include a chalk eraser, chalk dust collector and vacuum fan. A brusher mounted in the edge of inlet hole of chalk dust collector removes the chalk dust from the surface of eraser belt shape fabric and then the chalk dust is vacuumed into the collector chamber by vacuum fan. The roller shafts are inserted to the eraser bracket side holes and then go to the center of cylinder rollers.

The eraser belt shape fabric covers to the external of the four rollers and eraser bracket. The eraser belt fabric will be conveyed back and forth by the friction with rollers and erase the chalk dust from the blackboard. One filter bag installed in the collect chamber filters the chalk power from the inlet air of the vacuum fan. The vacuum function driven by fan and electric motor can transport the chalk power to the external surface of filter bag and no leaking to the outside and that harms the health for anyone nearby. The built-in rechargeable battery for the fan motor allows the eraser to be used cordlessly.

6 Claims, 7 Drawing Sheets

VACUUM ERASER FOR BLACKBOARDS

BACKGROUND OF THE INVENTION

1. Field of the Invention

The present invention relates to a vacuum eraser for blackboards and pertains to the removal of chalk dust from blackboards by combination an eraser and vacuum collecting devices. This vacuum eraser is convenience to be used as a result of the compact size design and the cordless vacuum ability.

2. Description of the Prior Art

The use of erasers in various designs and configurations is known in the prior art. These various eraser designs and configurations are utilized for the purpose of wiping off chalk dust from blackboards.

By way of example, the prior arts discloses are as follows:

U.S. Pat. No. 3,986,224 to Yang discloses an eraser with powder-collecting means (1976)

U.S. Pat. No. 4,007,509 to Odhner discloses blackboards eraser (1977)

U.S. Pat. No. 4,462,134 to Wang discloses blackboards eraser (1984)

U.S. Pat. No. 4,742,594 to Chen discloses blackboards eraser (1988)

U.S. Pat. No. 4,941,225 to Liao discloses automatic chalk-powder collecting device for blackboards eraser (1990)

U.S. Pat. No. 5,075,915 to Rodriguez discloses eraser cleaner (1991)

U.S. Pat. No. 5,099,541 to Tressler discloses blackboards eraser apparatus (1992).

U.S. Pat. No. 5,216,776 to Dennison discloses automatic blackboards eraser apparatus (1993)

U.S. Pat. No. 5,455,976 to Kim discloses apparatus for automatically brushing chalk powder off from blackboards eraser (1995)

U.S. Pat. No. D,366,670 to Huh discloses blackboards eraser (1996)

U.S. Pat. No. 5,530,984 to Walker discloses quick wipe eraser for chalkboards (1996)

After detail analysis the patented erasers in the prior art, they are all related to how to remove the chalk dust from blackboards completely and effectively. After using those erasers several times, the surface of eraser will be saturated with chalk dust and eventually the chalk dust will escape out and pollute to the air. The present invention for a Vacuum Eraser for Blackboards will vacuum out the chalk dust from the surface of eraser continuously so that is no pollution problem and will get better erasing every time by reason of the clean eraser surface.

BRIEF SUMMARY OF THE INVENTION

In this respect, the present invention for a Vacuum Eraser for Blackboards is substantially different from the designs of the prior arts.

In general a new structure design of blackboard eraser includes eraser container, brusher, eraser multiple rollers, eraser bracket, eraser belt fabric, vacuum fan and chalk dust collector. The overall advantage for newly invented Vacuum Eraser for Blackboards is as follows:

1) As the eraser belt is pushed, a brusher will contact and remove the chalk dust on belt surface. Subsequently the chalk dust is pulled into the chalk dust collector and separated with air by a filter bag and vacuum fan. This exclusive design is very compact and useful to the user.

2) The chalk dust collector on the upper of eraser can be separated from the erase container for cleaning out inside chalk dust. During vacuuming, the air pass through a filter bag and the chalk dust is collected inside the collector chamber.
3) The surface of the eraser belt fabric is fully supported by eraser bracket and multiply roller. During erasing, the eraser belt fabric is in full contact with the blackboard and the belt tension is remained by a roller spring kit.
4) The bracket for eraser side plate design keeps the eraser belt fabric in the track without separating from eraser.

Therefore, it can be anticipated that a new Vacuum Eraser for Blackboards can erase chalk dust from blackboards without producing any airborne chalk dust.

BRIEF DESCRIPTION OF THE SEVERAL VIEWS OF THE DRAWINGS

1. Illustration Description

Figure 1:
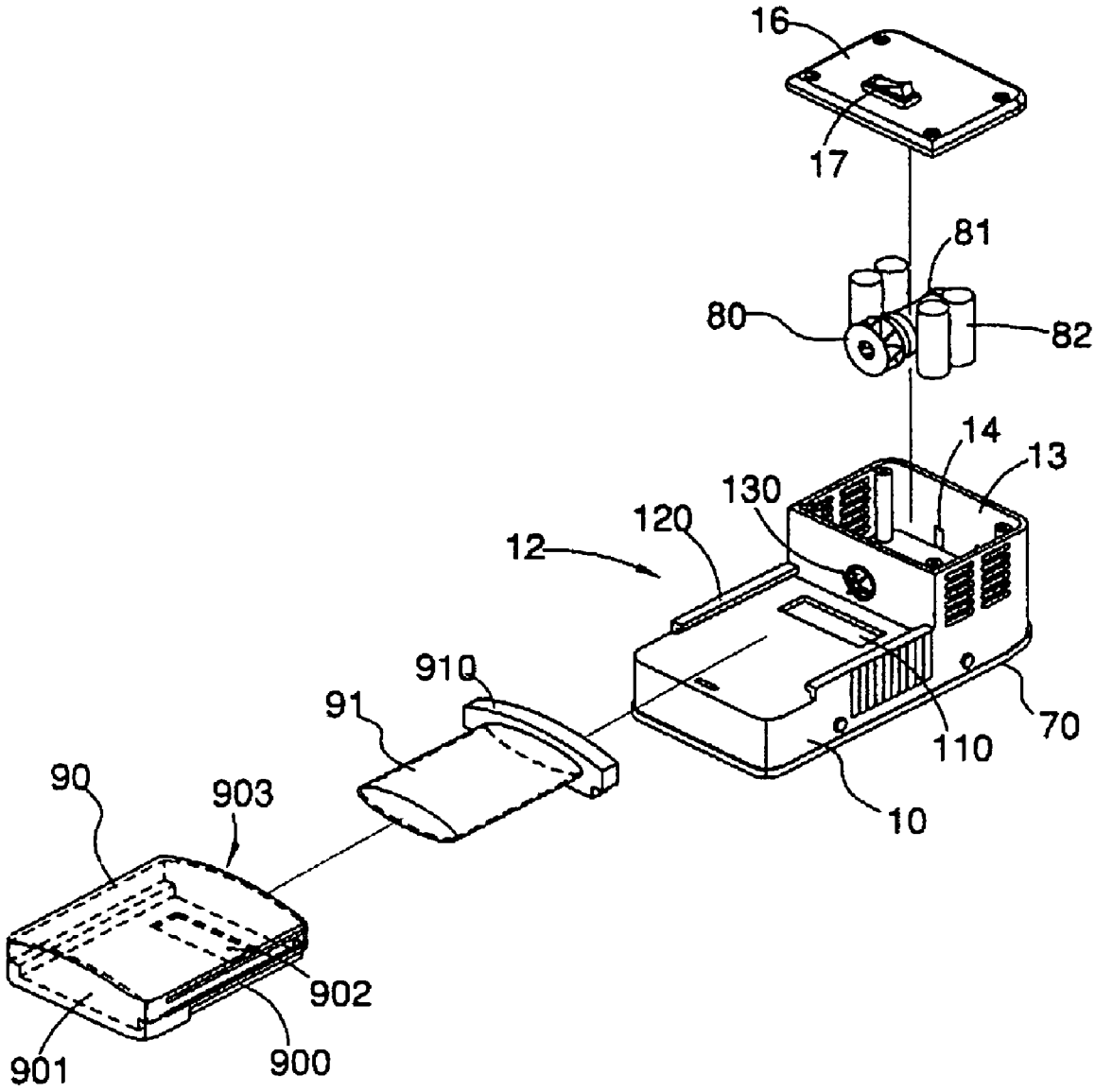
FIG. 1: Illustrates eraser upper view parts layout
Figure 2:
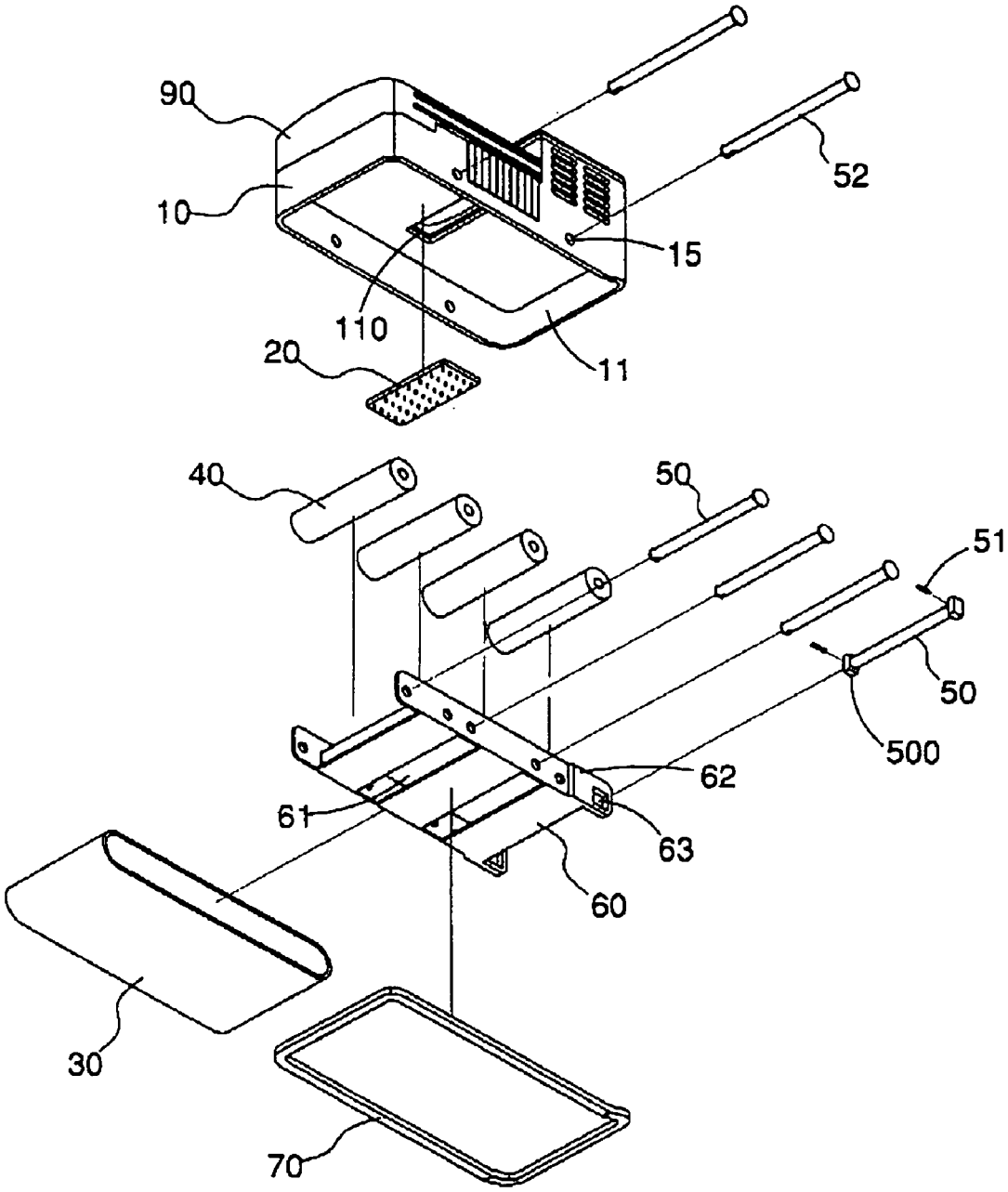
FIG. 2: Illustrates eraser lower view parts layout
Figure 3:
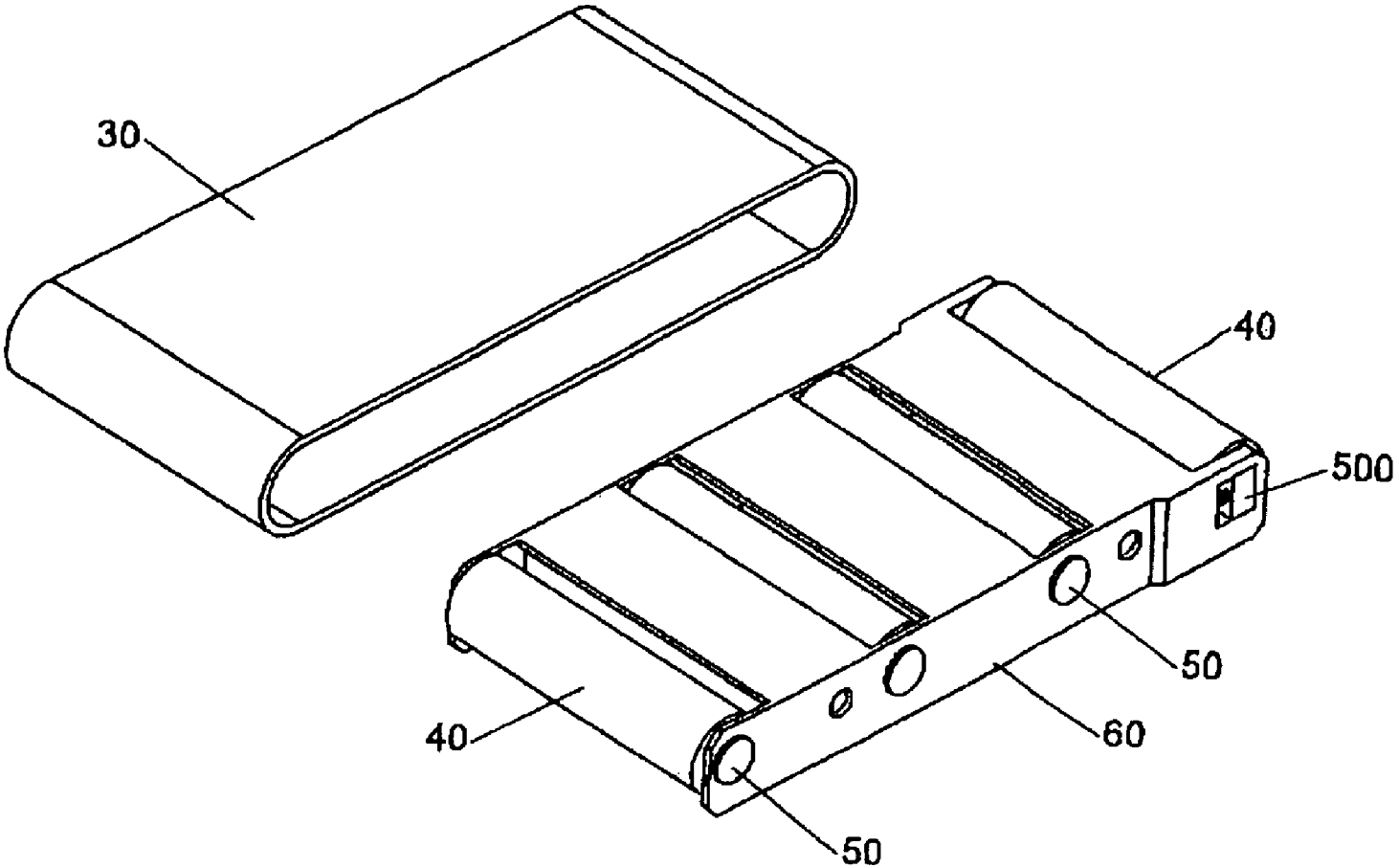
FIG. 3: Illustrates eraser bracket, rollers and belt fabric assembly layout
Figure 4:
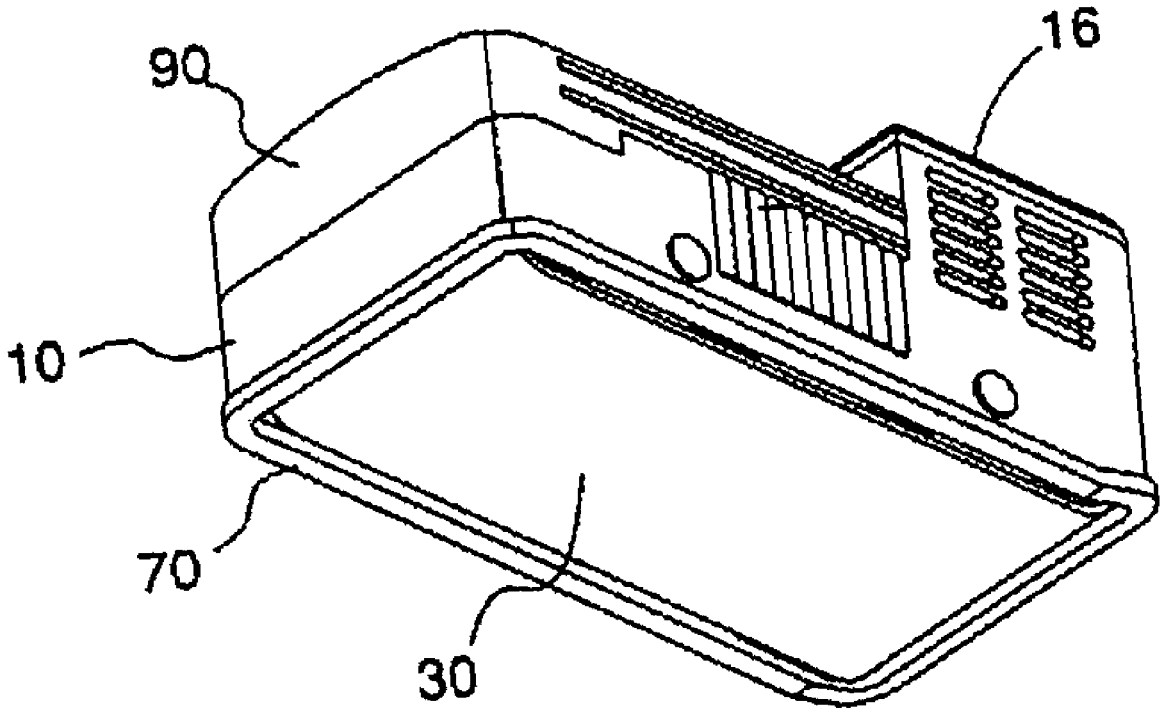
FIG. 4: Illustrates eraser overview

2. Part Description (10) Eraser container
(11) Eraser compartment
(110) Compartments door
(12) Collector compartment
(120) Collector guide bar
(13) Vacuum compartment
(130) Suction inlet
(14) Battery charge contactor
(15) Eraser bolts holes
(16) Vacuum compartment lid
(17) Vacuum power switch
(20) Brusher
(30) Eraser belt fabric
(40) Cylinder roller
(50) Roller shaft
(500) Roller knob
(51) Belt tension spring
(52) Latch bolt
(60) Eraser bracket
(61) Bracket opening
(62) Eraser bracket side plate
(63) Roller knob hole
(70) Soft gasket
(80) Vacuum fan
(81) Fan motor
(82) Battery
(90) Collector box
(900) Collector rails
(901) Collector chamber
(902) Chalk power inlet
(903) Collector box door
(91) Filter bag
(910) Filter bag open holder
(A) Battery charge station

DETAIL DESCRIPTION OF THE INVENTION

From FIG. 1 to no. 7 illustrates a new design in the structure of a vacuum eraser for blackboards. This major component includes a box shape eraser container (10), a brusher (20), four rollers (40), a bracket for eraser (60), an eraser belt fabric (30), soft gasket (70), a vacuum fan (80), and chalk dust collector box (90) etc. In the compartment arrangement, at the lower of eraser container (10) is the space of eraser compartment (11) and at the upper of eraser container (10), one section is for collector compartment (12) and the other section is for vacuum compartment (13). There is a doorway (110) in the eraser compartment (11) for the chalk dust inlet (902) of the collector compartment (90). Two sets of bolts holes (15) are placed on the each sidewall of eraser compartment (11).

Two "I" shape guide bars (120) are placed in the each side of collector compartment (12), which interconnects to the vacuum compartment (13) by a suction inlet (130). The vacuum compartment (13) has charge contactors (14) in the backside wall and one power on-off switch (17) on the compartment lid (16).

The brusher (20) placed by the side of chalk dust doorway (110) includes many small brushers spread in a wide area pad. Thanks to the location of the brusher (20), it closely contacts with one side of eraser belt fabric (30).

Four rollers (40) are joined to the eraser bracket (60) by means of their roller shaft (50) so that the roller spins freely among the eraser bracket (60). Besides, the roller shaft (50) for the outer roller (40) has knobs (500) inserted to the knob holes (63) and attach with a spring kit (51) with the purpose of keeping eraser belt fabric tension for the duration of rolling.

In order to lock the eraser body and eraser container (10), two latches bolts (52) pass through two latch holes (15) on each side of the eraser container (10) and two latches holes on each side of eraser bracket (62). In addition, four latch holes (50) on each side of eraser bracket (60) are used to fasten together the four rollers (40). The lower of roller (40) has exposed to the outside of the eraser bracket (62) from its opening (61).

The eraser belt fabric (30) in circle shape and encircles to the four rollers (40). The eraser belt fabric (30) will keep in the proper track and will not be separated from rollers (40) owing to being constrained by the side plates of the eraser bracket (60).

The eraser soft gasket (70), made by soft material, is installed around the edge of eraser container (10) and avoids any scratching to the surface of blackboard by the easer container (10).

Figure 7:
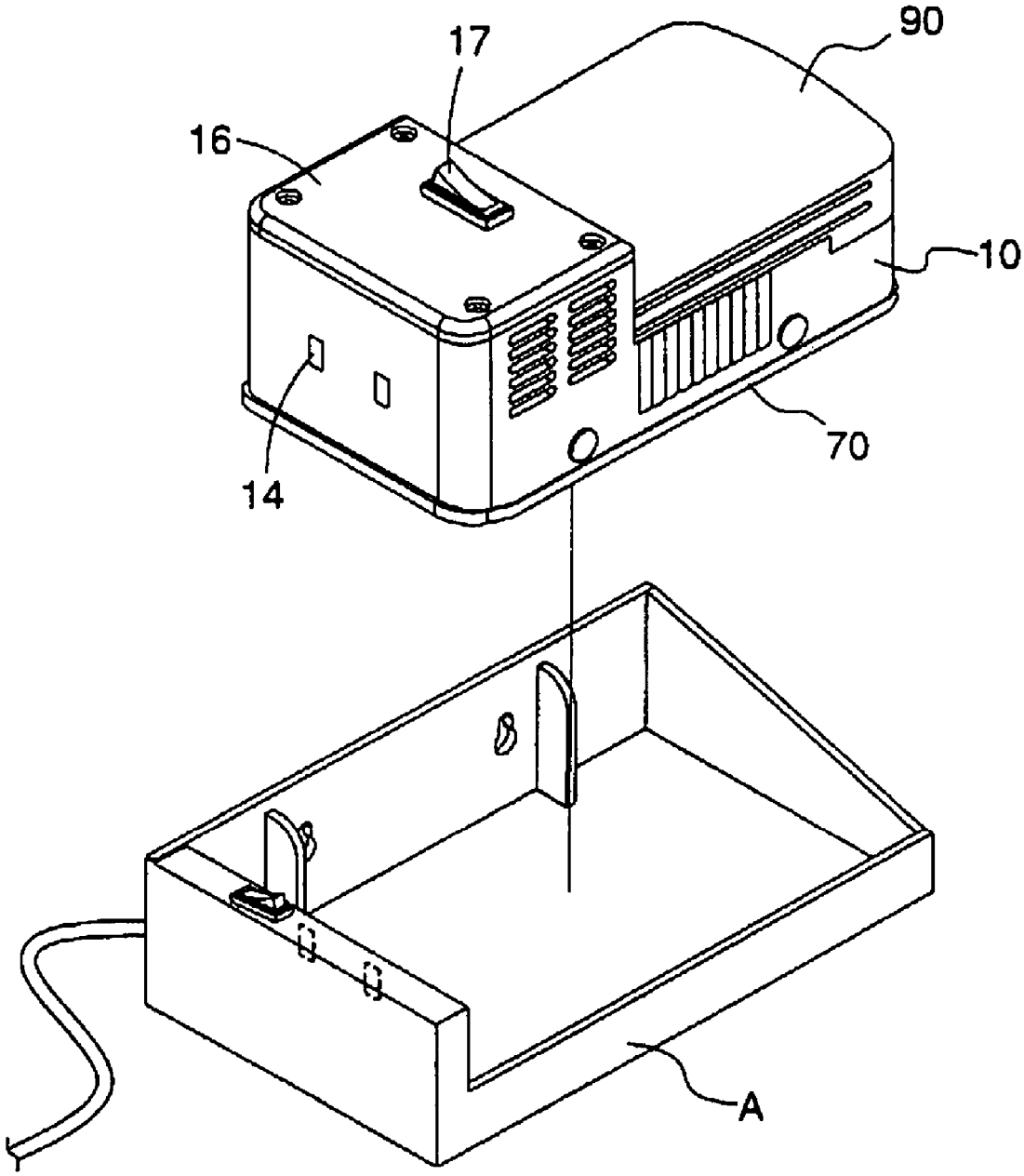
FIG. 7: Illustrates eraser battery charging layout

One motor (81) drives the vacuum fan (80) that is installed in the vacuum compartment (13) and vacuum air through front suction inlet (130). The motor (81) power source is from four batteries (82) in the vacuum compartment (13). The batteries are connected in circuit with the charge contactors (14) and can be re-charged in a charge station (A) as shown in FIG. 7.

The chalk dust collector box (90) has the rails (900) on both sides to slot in or out the guide bar (120) from the collector compartment (12). The chalk dust inlet (902) in the collector chamber (901) is directly open to the eraser compartment (11) doorway (110). The collector chamber (901) open door (903) is connected to the suction inlet (130) of vacuum fan (80). A separable holder (903) is to open the filter bag (91) and lock to the collector box (90).

Figure 5:
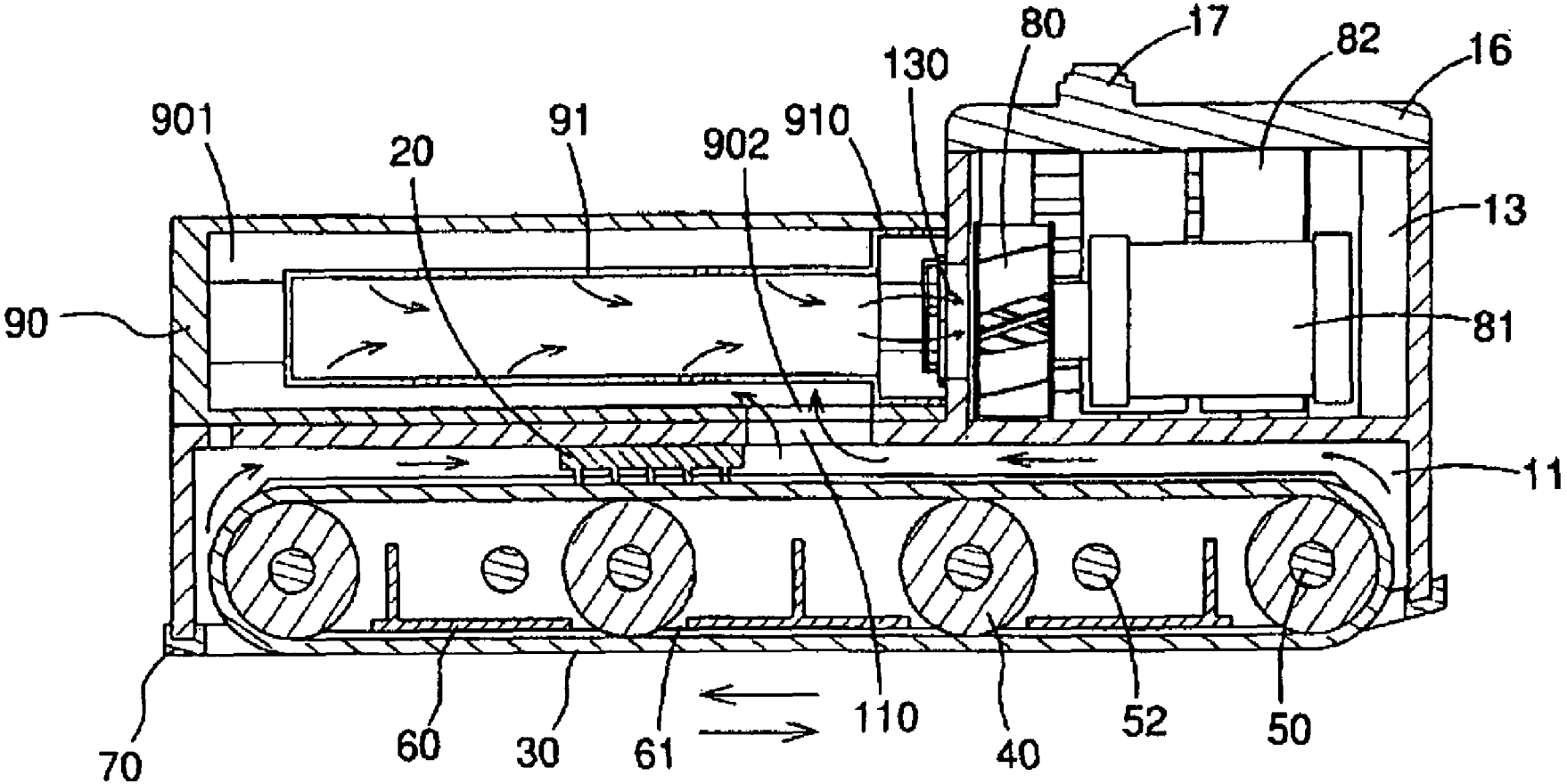
FIG. 5: Illustrates eraser functionality
Figure 6:
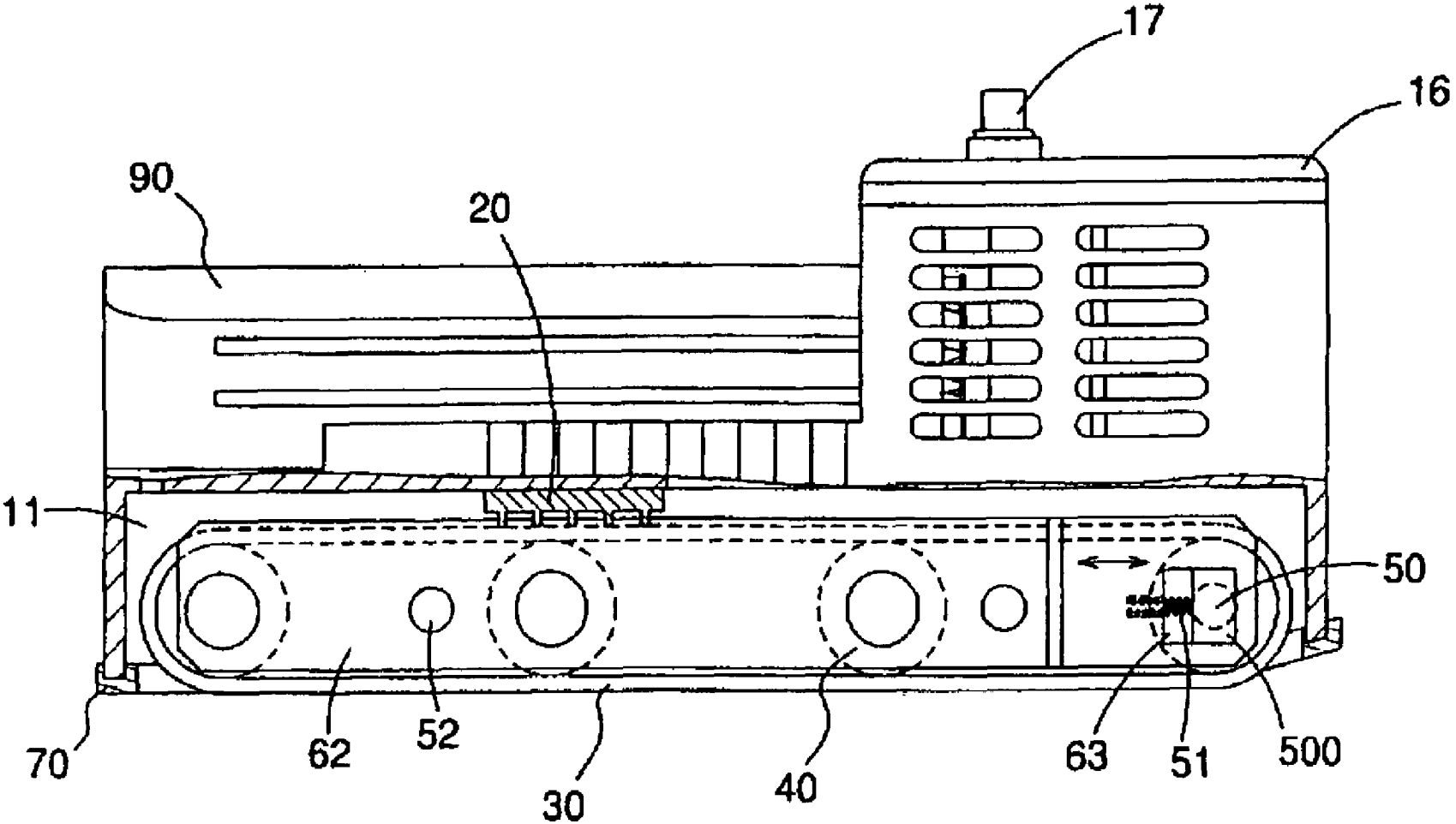
FIG. 6: Illustrates eraser side view

As the FIG. 5 shown, function view of erasing, while the eraser belt fabric (30) erases the chalk dust from blackboard, the fabric surface is rolled back to the other side and wiped out by the brusher (20). As soon as the fan power switch (17) is switched on, the vacuum fan (80) transfers the wiped chalk dust to the collector chamber (901). Once the collector chamber (901) is full, detach it from eraser container (10) for cleaning. From the FIG. 6 shown, while the eraser is pushed up or down, the displacement of roller knobs (500) in the outer roller (40) is against to the spring kit (51) that will keep the eraser belt (30) in the steady tension during erasing.

Thanks to the exclusive structure in this design, there are many advantages in practice as follows.

1) The erasing function is by means of the shift of eraser belt fabric (30) and brusher (20). The eraser belt fabric (30) is fully supported by the bracket for eraser (60) so the eraser contact area with blackboard is wide surface and the chalk dust is erased completely.
2) Both the chalk dust in the eraser belt fabric (30) and wiped out chalk dust by the brusher (20) will transfer to collector chamber (901) from vacuum fan (80). This vacuum function mainly reduces any chalk dust by pass to the air.
3) The vacuum fan (80) used for the chalk dust removal is installed directly in the eraser. This design makes this product more handy and space saving.

As above mentions, substantial advantages in the design and in the application, this new invention will reduce any risk in the health for the blackboards user.

What is claimed as being new and desiring to be protected by the Letters Patent of the United States is as follows:

1. A vacuum eraser for blackboards comprising:

an eraser container consisting of an eraser compartment positioned at a front of the eraser container, a vacuum compartment positioned at a rear of the eraser container, and a collector compartment positioned above the eraser compartment;

an eraser bracket assembly secured in the eraser compartment including cylindrical rollers, a fabric eraser belt wound around the cylinder rollers, and an eraser bracket;

a brush mounted in the eraser compartment next to an inlet door way which is in communication with the collector compartment, the brush contacting the fabric eraser belt for cleaning vacuum chalk powder from the eraser belt;

a vacuum fan mounted to the vacuum compartment and a fan motor coupled to the vacuum fan for driving the vacuum fan;

a collector box attached to the collector compartment and slidingly attached to the eraser compartment for storing vacuum chalk powder from the eraser compartment.

2. The vacuum eraser for blackboards as claimed in claim 1, wherein the collector compartment includes two sides r shape guide bars, the collector box have two side rails for engaging perfectly with the r shape guide bars to generate vacuum negative pressure which prevent chalk powder from leaking through, and a filter bag engaged into the collector box for storing the chalk powder and air.

3. The vacuum eraser for blackboards as claimed in claim 1, wherein the vacuum compartment comprises a lid mounted on the top of the vacuum compartment, a power switch mounted on the lid, and chargeable batteries mounted in the vacuum compartment.

4. The vacuum eraser for blackboard as claimed in claim 3, wherein the vacuum compartment comprises battery charge contactors mounted on the side of the vacuum compartment and coupled the chargeable batteries to a battery charging station.

5. The vacuum eraser for blackboards as claimed in claim 1, wherein the eraser compartment comprises a soft material pad ring installed on an edge of the eraser compartment.

6. The vacuum eraser for blackboards as claimed in claim 1, wherein the eraser bracket includes two eraser bracket side plates with roller knob holes, roller knobs of roller shafts, and belt tension spring engaged with the roller knobs.

* * * * *